US005411204A

United States Patent [19]

DeMay

[11] Patent Number: 5,411,204

[45] Date of Patent: May 2, 1995

[54] RECLOSABLE FOOD TRAY AND TRAY BLANK

[75] Inventor: Karl F. DeMay, Newark, N.Y.

[73] Assignee: Fold-Pak Corp., Newark, N.Y.

[21] Appl. No.: 36,510

[22] Filed: Mar. 24, 1993

Related U.S. Application Data

[63] Continuation of Ser. No. 855,774, Mar. 23, 1992, abandoned, which is a continuation of Ser. No. 577,517, Sep. 5, 1990, abandoned.

[51] Int. Cl.[6] ..... B65D 5/24; B65D 5/64

[52] U.S. Cl. ..... 229/114; 229/155; 229/186; 229/902

[58] Field of Search ..... 229/40, 114, 105, 155, 229/156, 186, 902, 903, 906; 426/113, 114, 119, 120, 124

[56] References Cited

U.S. PATENT DOCUMENTS

| | | | |
|---|---|---|---|
| 396,570 | 1/1889 | Hotchkiss | 229/114 |
| 1,982,557 | 11/1934 | Watson . | |
| 2,330,521 | 9/1943 | Scheide . | |
| 2,391,767 | 12/1945 | Beerend | 229/903 |
| 2,475,294 | 7/1949 | Rafoth . | |
| 2,528,016 | 10/1950 | Smith | 426/119 |
| 2,676,747 | 4/1954 | Lange . | |
| 2,801,930 | 8/1957 | Paulucci | 426/120 |
| 2,810,506 | 10/1957 | Kessler . | |
| 2,917,221 | 12/1959 | Risdon | 426/113 |
| 3,027,063 | 3/1962 | Zastrow | 229/40 |
| 3,043,068 | 7/1962 | Blonder . | |
| 3,128,725 | 4/1964 | Becker et al. | 426/113 |
| 3,146,933 | 9/1964 | Moore | 229/186 |
| 3,155,304 | 11/1964 | Beerend | 229/903 |
| 3,352,472 | 11/1967 | Cummings et al. | 426/119 |
| 3,542,569 | 11/1970 | Farquhar | 229/40 |
| 3,771,713 | 11/1973 | Davidson | 426/119 |
| 3,863,832 | 2/1975 | Gordon et al. | 426/113 |
| 3,871,357 | 3/1975 | Grosso et al. | 426/120 |
| 3,913,823 | 10/1975 | Lin . | |
| 3,983,256 | 9/1976 | Norris et al. | 426/124 |
| 4,036,423 | 7/1977 | Gordon | 229/903 |
| 4,202,465 | 5/1980 | McLaren | 426/114 |
| 4,253,602 | 3/1981 | Kulig . | |
| 4,277,506 | 7/1981 | Austin | 426/111 |
| 4,279,933 | 7/1981 | Austin et al. | 426/111 |
| 4,304,335 | 12/1981 | Bemiss | 426/113 |
| 4,308,985 | 1/1982 | Manizza et al. | 229/903 |
| 4,571,340 | 2/1986 | Ferrante et al. . | |
| 4,754,914 | 7/1988 | Wischusen, III | 229/40 |
| 4,757,940 | 7/1988 | Quick et al. | 229/903 |
| 4,930,639 | 6/1990 | Rigby | 229/903 |

FOREIGN PATENT DOCUMENTS

| | | | |
|---|---|---|---|
| 626234 | 8/1961 | Canada . | |
| 1405944 | 6/1965 | France | 229/155 |

OTHER PUBLICATIONS

Fold-Pak, Chinese Food Pail Blank No. 1J, 1977.

*Primary Examiner*—Gary E. Elkins

*Attorney, Agent, or Firm*—Hopgood, Calimafde, Kalil & Judlowe

[57] ABSTRACT

A reclosable food tray is disclosed generally comprising a receptacle portion and first and second pair of opposing closure flaps. The receptacle portion has a substantially trapazoidal volume defined by a rectangular shaped bottom panel and two substantially upstanding pair of opposing side panels. The two pair of opposing side panels define four pair of adjacent panels which are hingedly connected in a liquid-sealed manner by a folded gusset secured to the exterior surface of one of the adjacent side panels by adhesive. Each side panel is disposed at an obtuse angle measured from the bottom panel to facilitate stacking of the receptacle portion of successive trays. The first pair of opposing closure flaps extend from one pair of opposing side panels and are capable of closing off a portion of the access opening. The second pair of opposing closure flaps extend from the other pair of opposing side panels and are adapted to interlock with each other, overlap a portion of the first pair of opposing closure flaps, and close off the remaining portion of the access opening. In the preferred embodiment, the food tray is erected from a paperboard material which is substantially resistant to microwave and other heat radiation. In addition, an adhesive is used which resists melting upon exposure to microwave and other heat radiation. According to another aspect of the present invention, a tray blank is provided, from which the tray can be erected according to a simple, yet efficient method utilizing a minimum of folding operations.

20 Claims, 7 Drawing Sheets

RECLOSABLE FOOD TRAY AND TRAY BLANK

This application is a continuation of application Ser. No. 855,774, filed Mar. 23, 1992, now abandoned which, in turn, is a continuation of application Ser. No. 577,517, filed Sep. 5, 1990, now abandoned.

BACKGROUND OF THE INVENTION

1. Field of Invention

The present invention generally relates to a preconstructed folding food tray which is adapted to open and close easily and, more particularly, to a foldable tray blank and method of erecting the blank to form the constructed tray.

2. Brief Description of the Prior Art

Fast, convenient take-out and prepared food services have become a way of life in modern society. In response to commercial demand, a number of package designs have been developed to facilitate cooking or reheating "fast" food in a microwave or convection oven. These art-recognized designs include several folding cartons which exhibit a variety of shortcomings.

The Chinese food pail is universally known in the take-out food industry. It is preconstructed at the manufacturing plant by folding a precut blank and fastening the gusset flaps with glue or metallic wire. Commercial products of this type have been offered by Fold-Pak Corporation since approximately 1977. These containers typically have a deep, narrow configuration which makes them unsuitable for certain applications. For example, the so-called pails do not provide for separate storage of different types of food. They are equally unacceptable for food which cannot be compressed prior to consumption.

Another type of food carton is fashioned in the form of an open tray for storing a predetermined amount of food. It is constructed at the point of purchase from a pre-cut, pre-scored carton blank. These blanks are typically constructed by manually performing numerous, time-consuming folding and tucking operations. The resulting container often leaks at the corners formed by interlocking tabs and slots. Some variations employ glue to secure adjacent panels. They are not leak-proof or reclosable, and are therefore unsatisfactory for packaging prepared and take-out food.

Zastrow U.S. Pat. No. 3,027,063 discloses a diagonally folded carton in the form of a tray, having interior gusset flaps formed at each corner. The gusset flaps are automatically held in place, without adhesives, when the folded carton is closed by a pair of interlocking flaps. This construction has limited application because the walls of the carton are erect only when the closing flaps are in the locked position. In its open configuration the carton is unsuitable for liquid containing foods which necessarily leak. Preassembled carton blanks cannot be stacked or nested to facilitate shipping and storage. Similar limitations are exhibited by the paperboard food trays and blanks described in Webinger U.S. Pat. No. 4,340,169.

Alternative prior art food cartons are constructed from a pre-cut, pre-scored blank to form a substantially leak-proof container for commercial products such as TV and microwave dinners. But, these cartons exhibit several significant drawbacks. Adhesive is deposited on the interior surface of the blank, specifically between the adjacent panels which form each corner of the carton. When exposed to high temperature, this adhesive can cause undesirable contamination of the contents. These cartons also require a disposable, tamper evident cover portion which is destroyed when the package is opened. They are neither stackable nor reclosable, and are not suitable for packaging take-out or prepared food.

This disclosure indicates a clear need for a folding food carton which overcomes the deficiencies of earlier art-recognized techniques.

Accordingly, it is a primary object of the present invention to provide a preconstructed, reclosable food tray which is substantially leak-proof and adapted for exposure to microwave and other high temperature applications.

It is another object of the present invention to provide a convenient, reusable container for an assorted selection of take-out and prepared foods Another object is to provide a food tray which can be stacked or nested together in a space saving manner, and suitably wrapped for shipping to the end user.

It is a further object of the present invention to provide a food tray which has improved operability and improved "closeability" and which affords improved protection to the food contents after reclosing.

A further object of the present invention is to provide folding tray blanks which can be constructed in a simple and efficient manner.

Another object of the present invention is to provide tray blanks of varying configurations which are adapted with cuts and score lines to form an assembled tray container for take-out and prepared foods.

Another object of the present invention is to provide an environmentally attractive food tray made from biodegradable material.

A further object of the present invention is to provide tray blanks which are adapted for manufacture from paperboard sheet stock using high-speed cutting and scoring machines.

It is a further object of the present invention to provide tray blanks using a minimum amount of stock during the cutting and scoring operations.

A further object of the present invention is to provide a method of erecting the food tray with a minimal number of high speed operations.

Based on this disclosure, additional objects of the present invention will be apparent to those with ordinary skill in the pertinent art.

SUMMARY OF THE INVENTION

A reclosable food tray is provided by one aspect of the present invention. The tray is constructed from a single unitary blank, and comprises a receptacle portion and first and second pair of opposing closure flaps.

The receptacle portion has an access opening which permits introduction of food. Its volume is defined by a rectangular shaped bottom panel and two substantially upstanding pair of opposing side panels. The two pair of opposing side panels extend substantially upright from the bottom panel and define four pair of adjacent side panels at the corners of the bottom panel. Each pair of adjacent side panels are hingedly connected in a liquid-sealed manner, by a folded gusset unitary with the respective adjacent side panels, and is secured to the exterior surface of one of the adjacent side panels by an adhesive applied between the folded gusset and the exterior surface. Each side panel is disposed at an obtuse angle measured from the bottom panel to facilitate stacking of the receptacle portion of successive, partially assembled trays. The first pair of opposing closure flaps extend from one pair of opposing side panels and are capable of covering or closing off a portion of the access opening. The second pair of opposing closure flaps extend from the other pair of opposing side panels and are adapted to cooperate with each other, overlap a portion of the first pair of opposing closure flaps, and cover the remaining portion of the access opening. Each folded gusset is suitably dimensioned so that the receptacle portion is capable of retaining liquids or semi-solid consumables without leakage.

In the preferred embodiment, the food tray is erected from a paperboard material which is substantially resistant to microwave and other heat radiation. An adhesive is used which resists melting upon exposure to high temperature. With the food tray of the present invention, food can be safely and efficiently heated in a microwave or convection oven.

According to another aspect of the present invention, a tray blank is provided having a planar unitary construction and a substantially rectangular gross geometry. The blank generally comprises a bottom panel; first and second pair of opposing side panels; four foldable gussets and first and second pair of opposing closure panels.

The bottom panel has a rectangular shape and a surface area defined by a first and second pair of opposing bottom fold lines. The first and second pair of opposing side panels are hingedly connected to the bottom panel at the first and second pair of opposing bottom fold lines, respectively. These opposing panels define four pair of adjacent side panels, each adjoining at a corner of the bottom panel. Each foldable gusset is hingedly connected to each pair of adjacent side panels. When the first and second opposing side panels are folded substantially upright with respect to the bottom panel, the tray receptacle with an access opening is formed, each gusset is folded adjacent to an exterior portion of one side panel and each side panel is disposed substantially upright at a predetermined obtuse angle with respect to the bottom panel.

The first pair of opposing closure panels is hingedly connected to the first pair of opposing side panels. Each closure panel is adapted to close off a portion of the access opening when folded and disposed substantially parallel to the bottom panel. The second pair of opposing closure panels is hingedly connected to the second pair of opposing side panels, and adapted to overlay a portion of the first pair of opposing closure panels and close off the remaining portion of the access opening. A fastening means may be provided for selectively opening and closing the second pair of closure panels.

Another aspect of the present invention concerns a novel method of erecting a food tray from a blank in a simple, yet highly efficient manner with a minimum number of folding operations.

BRIEF DESCRIPTION OF THE DRAWINGS

Reference is made to the following detailed description of the preferred embodiment in connection with the accompanying drawings, wherein.

DETAILED DESCRIPTION OF THE PREFERRED EMBODIMENTS

Figure 1:
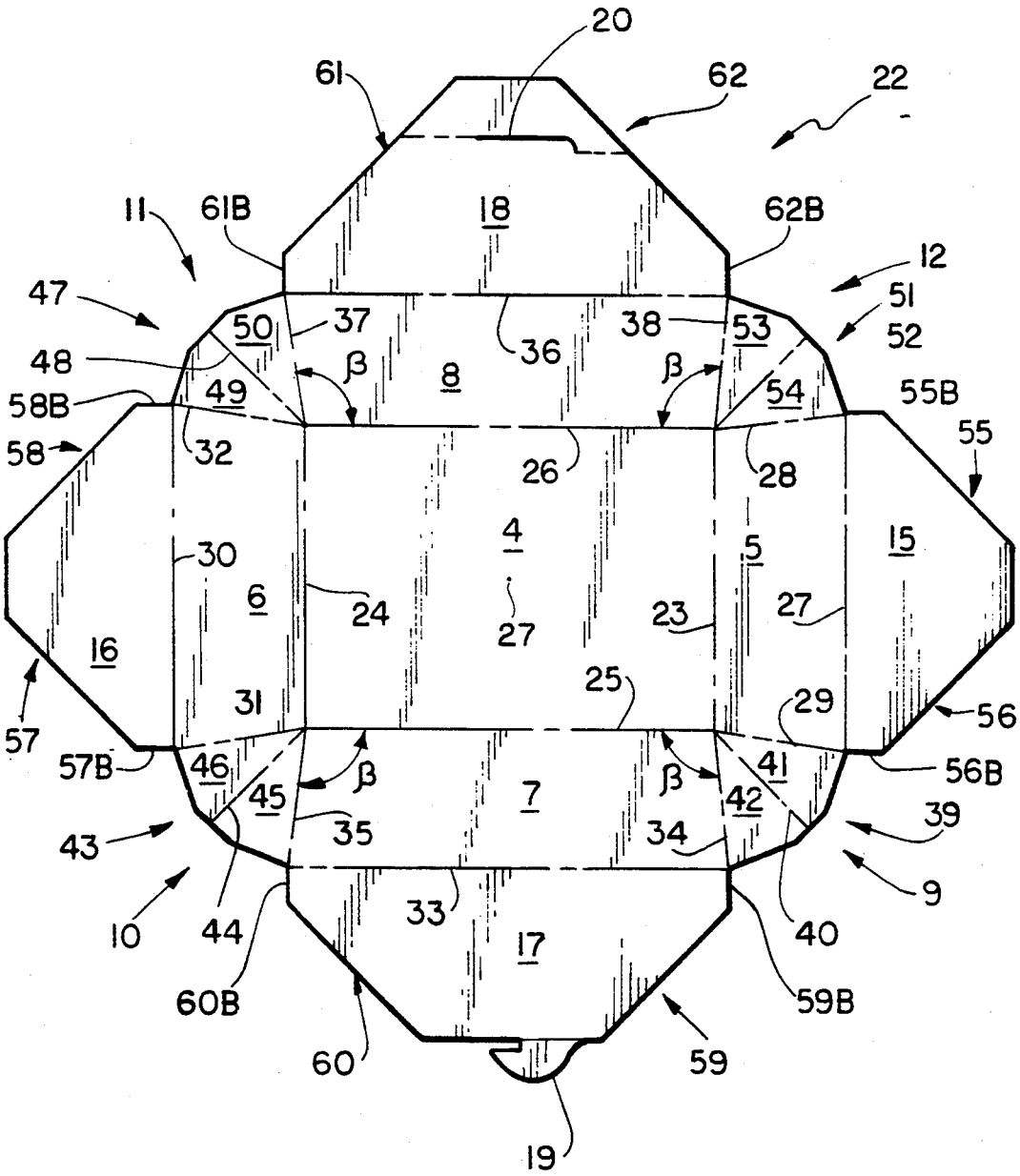
FIG. 1 is a plan view of the new and improved tray blank of the present invention.

FIGS. 6–10 illustrate the reclosable food tray 1 of the present invention. The reclosable food tray 1, which is formed from the single unitary blank 22 shown in FIGS. 1 through 5, includes a receptacle portion 2 of generally trapezoidal dimensions. An access opening indicated by reference numeral 3 is provided in the receptacle portion 2 to permit introduction of consumable goods.

Figure 5:
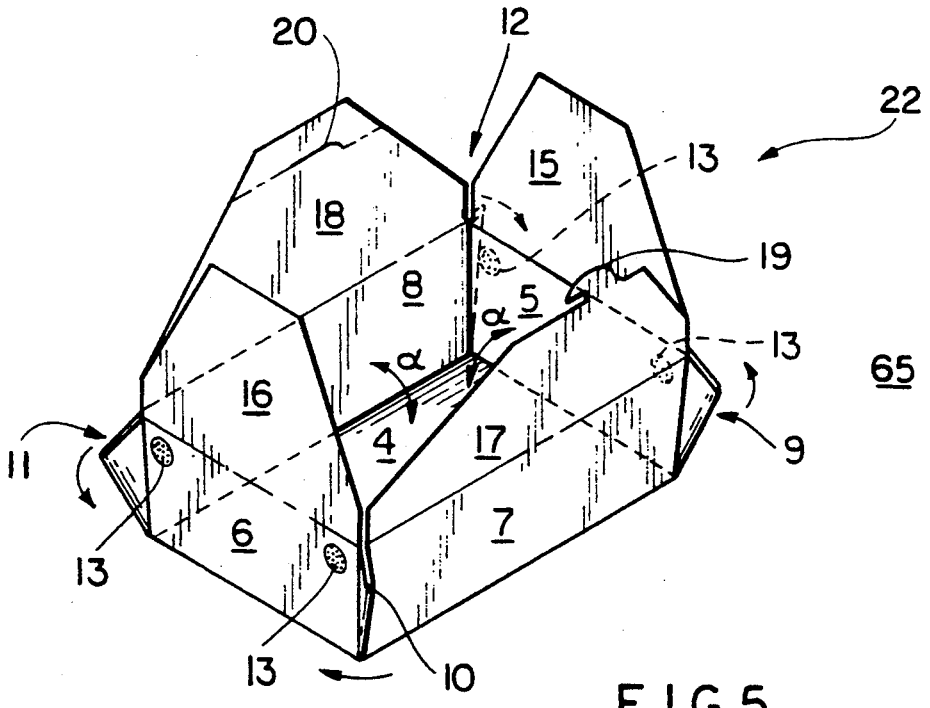
FIG. 5 is a perspective view of the tray blank shown at the end of the second stage (and beginning of the third stage) of folding operation.

The trapezoidal-like volume of receptacle portion 2 is defined by a rectangular shaped bottom panel 4 and a substantially upstanding pair of opposing side panels, i.e., first and second side panels 5, 6 and third and fourth side panels 7, 8, respectively. Each pair of adjacent side panels 5 and 7, 7 and 6, 6 and 8, and 8 and 5 are hingedly connected by folded gussets 9, 10, 11, and 12, respectively. Each folded gusset is unitary with its adjacent side panels, and secured to the exterior surface of one adjacent side panel by an adhesive 13 applied between each folded gusset and exterior surface as shown in FIG. 5. The adhesive 13 should resist melting when exposed to microwave and other heat radiation.

Figure 6:
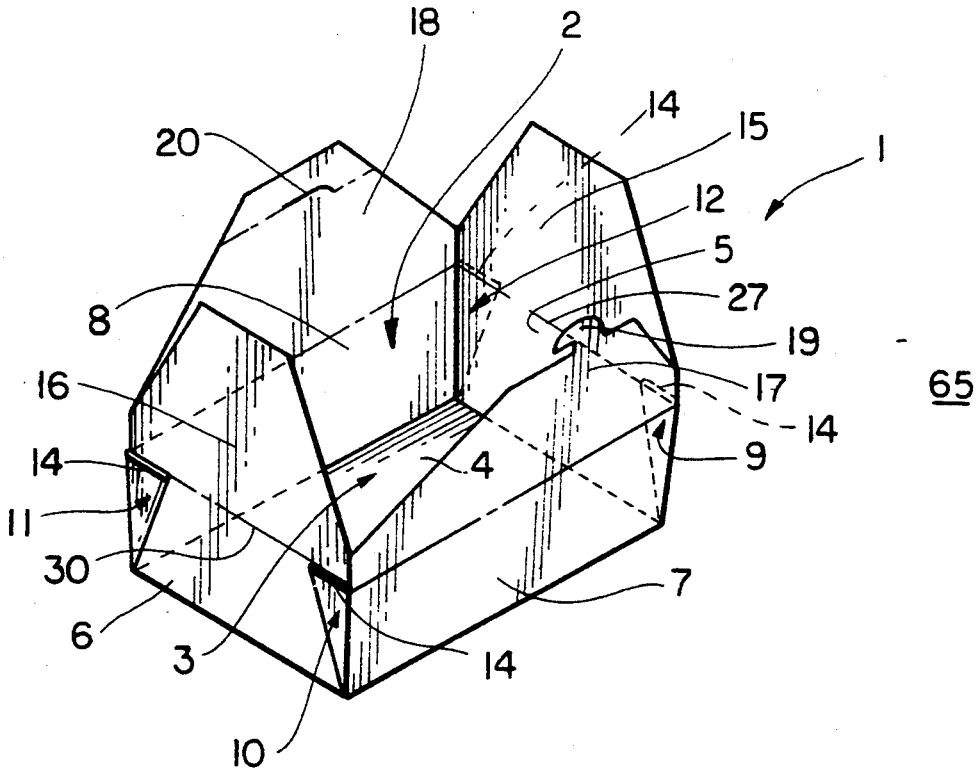
FIG. 6 is a perspective view of the tray blank after it has been completely folded to form the food tray of the present invention, being shown in its erected position ready for stacking with other like trays into a nested bundle.

In the preferred embodiment, each folded gusset has a geometry approximating a triangle, assuring that upper edge 14 of each folded gusset extends substantially along respective top fold lines 27 and 30 between closure flaps and side panels, as illustrated in FIG. 6. This feature ensures maximum support to side panels 5 and 6 and improves the overall structural integrity of food tray 1.

Figure 9:
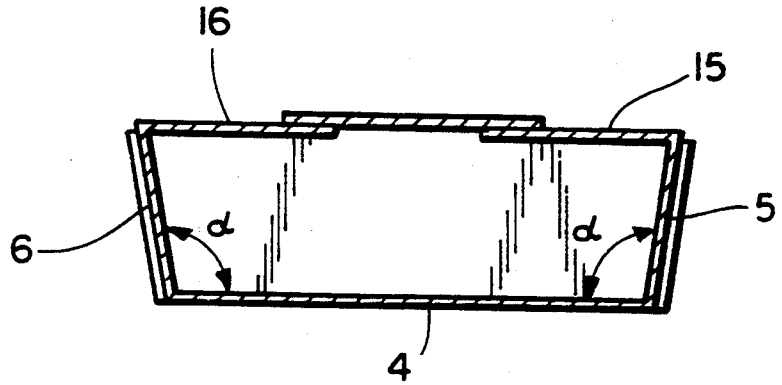
FIG. 9 is an elevated cross-sectional view of the tray taken along line 9—9 of FIG. 8.
Figure 10:
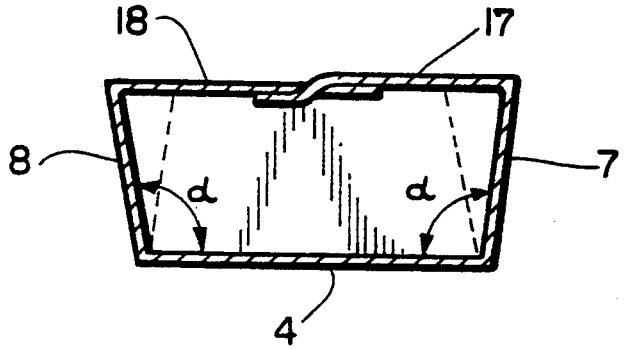
FIG. 10 is an elevated cross-sectional view of the tray taken along line 10—10 of FIG. 8.

As best illustrated in FIGS. 9 and 10, first, second, third and fourth side panels 5, 6, 7 and 8, respectively, are each disposed at an obtuse angle $\alpha$ (as measured from the rectangular bottom panel 4) to form trapezoidal-like receptacle portion 2. This volumetric geometry facilitates stacking or nesting of successive receptacle portions for storage or shipping purposes.

Figure 7:
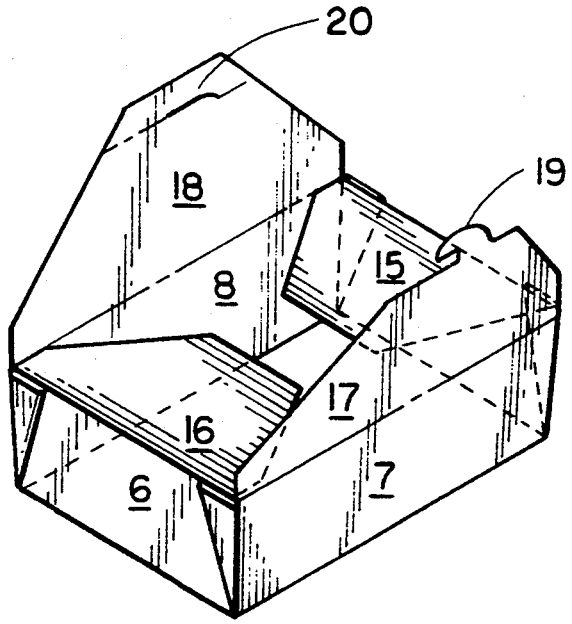
FIG. 7 is a perspective view of the tray shown in its erected position, with one pair of closure panels being partially folded into the closed position.
Figure 8:
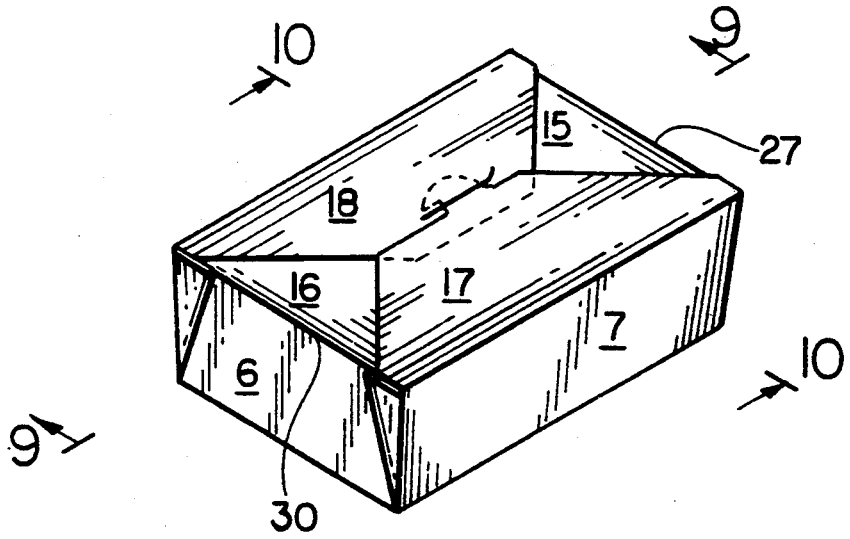
FIG. 8 is a perspective view of the tray shown with the second pair of closure panels folded down and interlocked to define the closed tray.

As illustrated in FIG. 6, food tray 1 also includes a first pair of opposing closure panels 15 and 16, and a second pair of opposing closure panels 17 and 18. These flaps typically extend vertically upright when the trays are nested and when food is introduced to receptacle portion 2. Closure flaps 15 and 16, which extend from opposing side panels 5 and 6, are capable of being folded downwardly into a position substantially parallel with bottom panel 4 to close off a portion of access opening 3, as illustrated in FIG. 7. Closure flaps 17 and 18, which extend from opposing side panels 7 and 8, are adapted to interlock by means of tab 19 formed on flap 17 and slot 20 formed in flap 18. When closure flaps 17 and 18 are folded downwardly into a position substantially parallel with bottom panel 4 and over closure flaps 15 and 16, as shown in FIG. 8, the remaining portion of access opening 3 is effectively closed off. When tab 19 on flap 17 is inserted through slot 20, closure flaps 17 and 18 are interlocked to close food tray 1. Interlocking tab 19 and slot 20 permit selective operation of closure flaps 15, 16, 17 and 18 to repeatedly open and close food tray 1.

Figure 13:
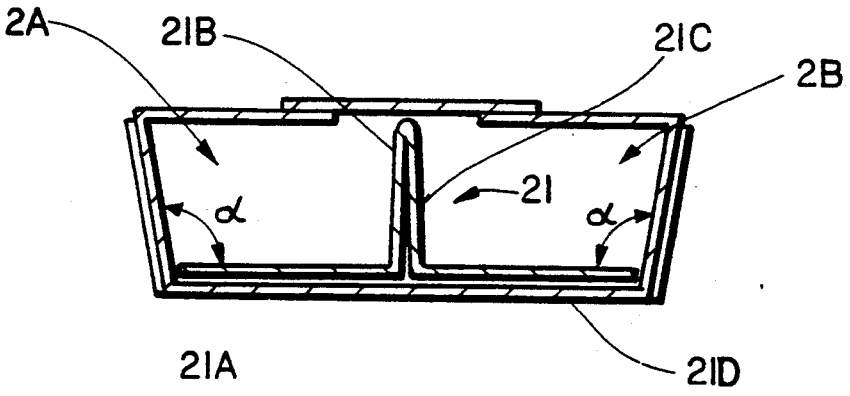
FIG. 13 is a perspective view of the tray shown with a folded partition installed in the receptacle portion to establish more than one isolated food storage compartment.

As illustrated in FIG. 13, a folded partition 21 may be inserted into the bottom portion of the tray prior to packaging food. This partition divides food receptacle portion 2 into more than one storage compartment, illustrated by areas 2A and 2B. In the preferred embodiment, partition 21 comprises four hingedly connected panels 21A, 21B, 21C and 21D. Panels 21B and 21C are folded back upon each other in a face-to-face relationship, with panels 21A and 21D disposed against bottom panel 4 to provide base panels for the storage compartments. With the installation of partition 21, several consumables may be physically isolated for separate storage or presentation.

Referring to FIG. 1, one embodiment of the blank for forming tray 1 will now be described. Blank 22 is formed from a single sheet of paperboard material suitable for holding, heating (reheating) and cooking food. This material can include any type of paperboard that can withstand the heat generated in a microwave or convection oven. Examples of such commercially available material include solid bleached board (SBS) and "ovenboard", having a weight in the range from 14 point to 42 point.

Blank 22 has a planar, unitary construction and a substantially rectangular gross geometry as shown in FIG. 1. It has an interior side which contacts the contents of an assembled tray, and an exterior side exposed to the ambient environment. Blank 22 also has a plurality of edges which define outer boundaries, and a plurality of score lines which hingedly connect adjacent panels. Edge portions and fold lines are formed in a paperboard sheet using conventional high-speed cutting and embossing technology. As will be described in great detail, a predetermined folding sequence is used to erect food tray 1 from blank 22.

Blank 22 includes bottom panel 4 characterized by a rectangular shape and a surface area defined by a first and second pair of opposing bottom edge fold lines 23, 24 and 25, 26, respectively. For reference purposes, the center of bottom panel 4 is indicated by numeral 27. The first and second pair of opposing side panels 5, 6 and 7, 8 are hingedly connected to bottom panel 4 along the first and second pair of opposing bottom fold lines 23, 24 and 25, 26, respectively. Each of the first and second pair of opposing side panels are characterized by fold lines which define its area, as well as the adjacent panels that are hingedly connected thereto. The specific character of each panel will now be described.

First side panel 5 is contiguous with and hingedly connected to bottom panel 4 along first bottom fold line 23. This side panel 5 has a surface area defined by first top fold line 27, first left side fold line 28, first right side fold line 29 and first bottom fold line 23 The terms "left" "right" "top" and "bottom" are defined by reference to center point 27 of bottom panel 4 in FIG. 1. As shown, first top and bottom fold lines 27 and 23 are substantially parallel, and first left and right side fold lines 28 and 29 diverge from first bottom fold line 23 at a predetermined obtuse angle $\beta$, illustrated as more than 90°.

Second side panel 6 is disposed opposite first side panel 5 and is contiguous with and hingedly connected to bottom panel 4 along second bottom fold line 24. This side panel 6 has surface area defined by a second top fold line 30, second left side fold line 31, second right side fold line 32 and second bottom fold line 24. As shown, second top and bottom fold lines 30 and 24 are substantially parallel, and second left and right side fold lines 31 and 32 diverge from second bottom fold line 24 at predetermined obtuse angle $\beta$.

Third side panel 7 is contiguous with and hingedly connected to bottom panel 4 along third bottom fold line 25. This side panel 7 has a surface area defined by third top fold line 33, third left side fold line 34, third right side fold line 35 and third bottom fold line 25. As shown, third top and bottom fold lines 33 and 25 are substantially parallel, and third left and right side fold lines 34 and 35 diverge from third bottom fold line 25 at predetermined obtuse angle $\beta$.

Fourth side panel 8 is disposed opposite third side panel 7 and is contiguous with and hingedly connected to bottom panel 4 along fourth bottom fold line 26. This side panel 8 has a surface area defined by fourth top edge fold line 36, fourth left side fold line 37, fourth right side fold line 38 and fourth bottom fold line 26. Fourth top and bottom fold lines 36 and 26 are substantially parallel and fourth left and right side fold lines 37 and 38 diverge from fourth bottom fold line 26 at predetermined obtuse angle $\beta$. These opposing side panels 5, 6 and 7, 8 define four pair of adjacent side panels, i.e., 7, 5; 5, 8; 8, 6 and 6, 7.

As illustrated in FIG. 1, foldable gussets 9 through 12 are formed by hingedly connected adjacent side panels. When opposing side panels 5, 6 and 7, 8 are folded substantially upright, tray receptacle 2 with access opening 3 is formed and, as shown in FIG. 5, gussets 9, 12 and 10, 11 and are folded against an exterior portion of adjacent side panels 5 and 6, respectively. At this point side panels 5 through 8 are disposed upright at the predetermined obtuse angle $\alpha$, measured with respect to bottom panel 4. Each foldable gusset 9 through 12 is characterized by fold lines and edges which define its area, and by adjacent panels that are hingedly connected thereto. The specific character of these corner gussets will now be described with continuing reference to FIG. 1.

First foldable gusset 9 is contiguous with first and third side panels 5 and 7, and has first corner edge 39 and first corner (i.e., diagonal) fold line 40, which divides the gusset into first left corner panel 41 and first right corner panel 42. First left corner panel 41 has a surface area defined by first right side fold line 29, first corner fold line 40 and a first portion of first corner edge 39. Similarly, the first right corner panel 42 has a surface area defined by third left side fold line 34, first corner fold line 40 and a second portion of first corner edge 39.

Second foldable gusset 10 is contiguous with third and second side panels 7 and 6, and has second corner edge 43 and second corner fold line 44 which divides second gusset 10 into second left corner panel 45 and second right corner panel 46. Second left corner panel 45 has a surface area defined by third right side fold line 35, second corner fold line 44 and a first portion of second corner edge 43. Second right corner panel 46 has a surface area defined by second left side panel fold line 31, second corner fold line 44 and a second portion of second corner edge 43.

Third foldable gusset 11 is contiguous with second and fourth side panels 6 and 8, and has third corner edge 47 and third corner fold line 48 which divides third gusset 11 into third left corner panel 49 and third right corner panel 50. Third left corner panel 49 has a surface area defined by second right side fold line 32, third corner fold line 48 and a first portion of third corner edge 47. Third right corner panel 50 has a surface area defined by fourth left side fold line 37, third corner fold line 48 and a second portion of third corner edge 47.

Fourth foldable gusset 12 is contiguous with fourth and first side panels 8 and 5, and has fourth corner edge 51 and fourth corner fold line 52 which divides fourth gusset 12 into fourth left corner panel 53 and fourth right corner panel 54. Fourth left corner panel 53 has a surface area defined by fourth right side fold line 38, fourth corner fold line 52 and a first portion of fourth corner edge 51. Fourth right corner panel 54 has a surface area defined by first left side fold line 28, fourth corner fold line 52 and a second portion of fourth corner edge 51.

As illustrated in FIG. 1, first pair of opposing closure panels 15 and 16 are hingedly connected to first pair of opposing side panels 5 and 6, respectively. Panels 15 and 16 are dimensioned to close off a portion of access opening 3 of erected tray 1 when these panels are folded down and disposed substantially parallel to bottom panel 4, as illustrated in FIG. 7. First closure panel 15 has a surface area generally defined by first top fold line 27, left closure panel edge 55 and first right closure panel edge 56. Second closure panel 16 has a surface area generally defined by second top fold line 30, second left closure panel edge 57, and second right closure panel edge 58. Closure panels 15 and 16 also have edge portions indicated by 55B, 56B, and 57B, 58B, respectively, which are substantially parallel to each other and to bottom fold lines 25 and 26.

The second pair of opposing closure panels 17 and 18 are hingedly connected to second pair of opposing side panels 7 and 8. Panels 17 and 18 are dimensioned to close off the remaining portion of access opening 3 of erected tray 1 when these panels are folded down and disposed substantially parallel to bottom panel 4, as illustrated in FIG. 8. Third closure panel 17 has a surface area generally defined by third top fold line 33, third left closure panel edge 59 and third right closure panel edge 60. Fourth closure panel 18 has a surface area generally defined by fourth top fold line 36, fourth left closure panel edge 61 and fourth right closure panel edge 62. Closure panels 17 and 18 also have edge portions indicated by 59B, 60B, 61B and 62B, respectively, which are substantially parallel to each other and bottom fold lines 23 and 24. In order to achieve selective interlocking of panels 17 and 18, when positioned over panels 15 and 16 and access opening 3, panel 17 is provided with tab 19 and panel 18 is provided with matched slot 20, as illustrated in FIG. 1. It will be appreciated that alternative fastening means may be used to provide for selective opening and closing of the erected food tray.

Figure 2:
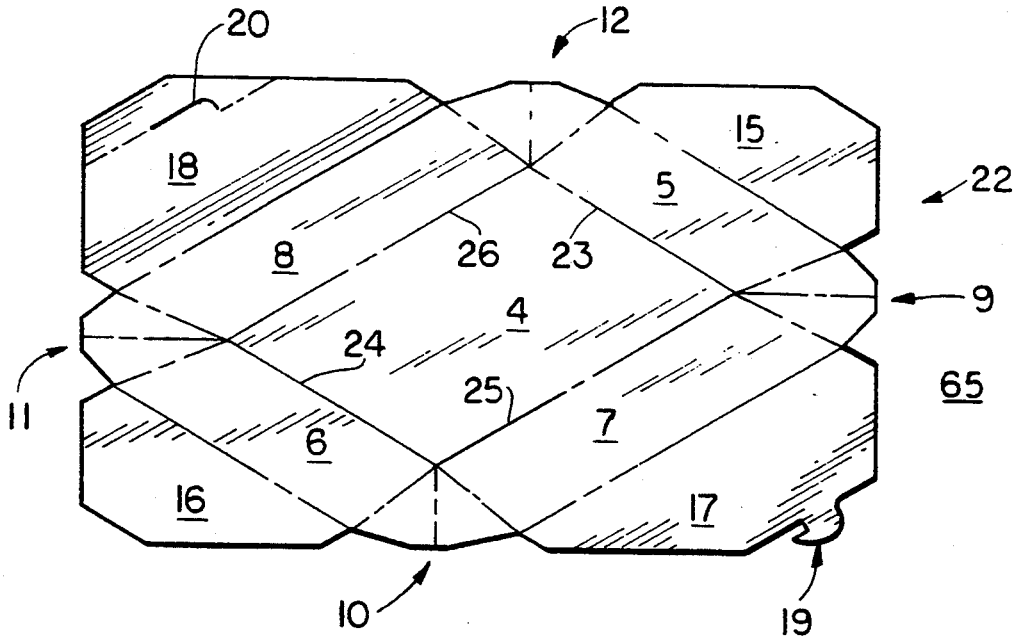
FIG. 2 is a perspective view of the tray blank shown disposed in its planar, unfolded configuration.
Figure 3:
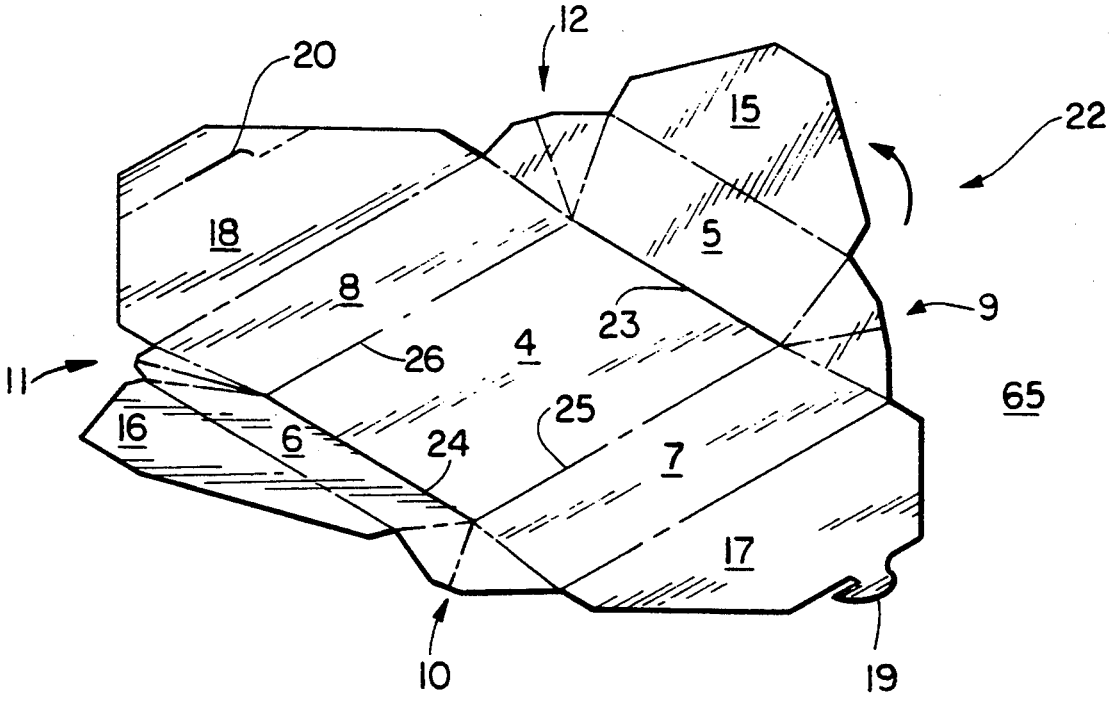
FIG. 3 is a perspective view of the tray blank shown during the first stage of folding operation according to the method of the present invention.

Referring to FIGS. 2 through 6, the method of erecting food tray 1 from blank 22 will now be described below. As shown in FIG. 2, tray blank 22 is disposed in plane 65 designated as 0° reference. Then, as shown in FIG. 3, one pair of opposing side panels 5 and 6 are folded about lines 23 and 24 into a partially upright position at about 20° from reference plane 65. During this first stage of the folding operation, gussets 9, 10, 11 and 12 are lifted away from reference plane 65 as shown.

Figure 4:
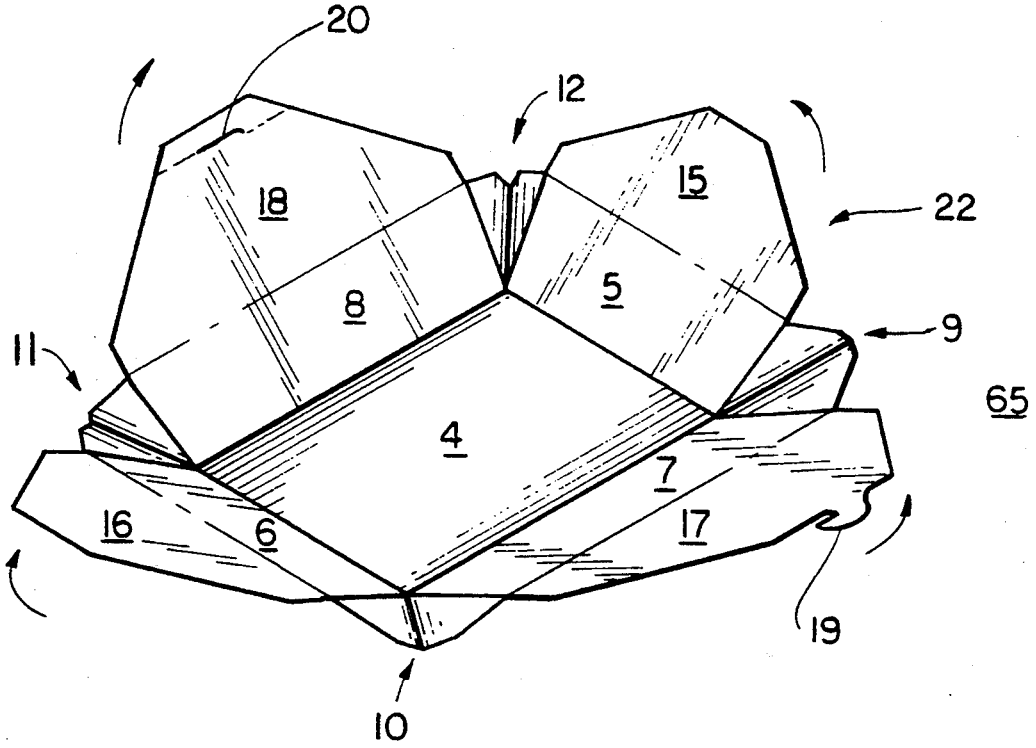
FIG. 4 is a perspective view of the tray blank shown at the beginning of the second stage of folding operation.

Next, opposing side panels 7 and 8 are rotated in the upright direction as shown in FIG. 4. During this second stage of folding operation, left and right panels of each gusset are brought into face-to-face contact with each other. At the end of the second stage, first and second pair of opposing side panels 5, 6 and 7, 8 are disposed in a substantially upright configuration, as illustrated in FIG. 5, and each folded gusset lies closer, in the angular sense, to second pair of opposing side panels 7 and 8 than to first pair of side panels 5 and 6.

At or near the end of the second stage shown in FIG. 5, adhesive 13 is applied to the exterior surface of each left and right end portion of side panels 7 and 8. Thereafter, gussets 9 through 12 are folded against the exterior surfaces of panels 5 and 6 where adhesive 13 has been applied. With adhesive 13 between each folded gusset and exterior surface, gussets 9 through 12 are secured after a time period sufficient for curing, thereby providing assembled tray 1, as shown in FIG. 6.

In the preferred embodiment, assembled tray 1 is inserted within receptacle portion 2 of a previously constructed tray. In this tray nesting arrangement, suitable pressure can be applied to the folded down gussets while the adhesive sets, ensuring that the gussets are not permitted to unfold during curing.

Figure 11:
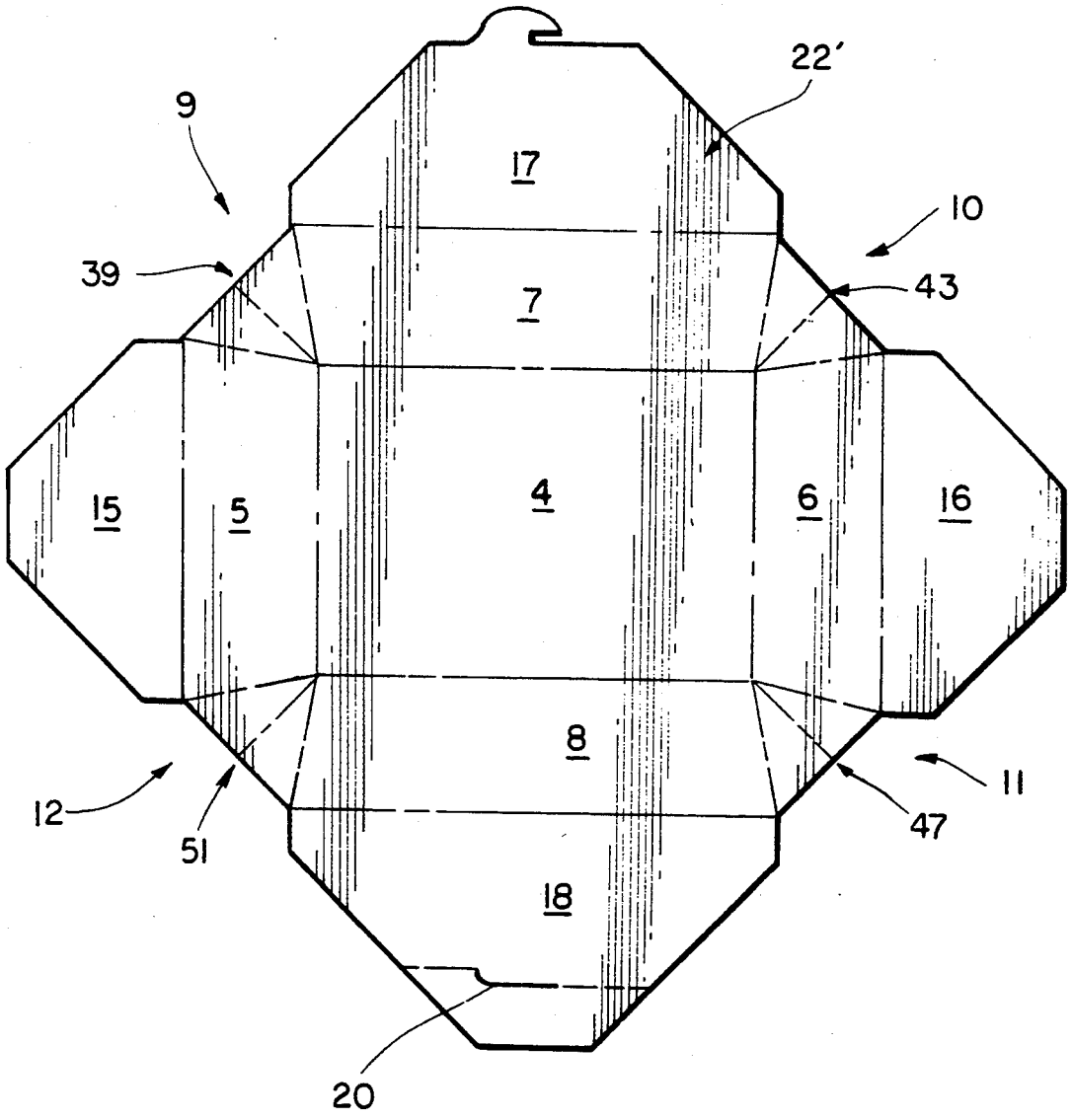
FIG. 11 is a plan view of a modified embodiment of the tray blank shown in FIG. 1.
Figure 12:
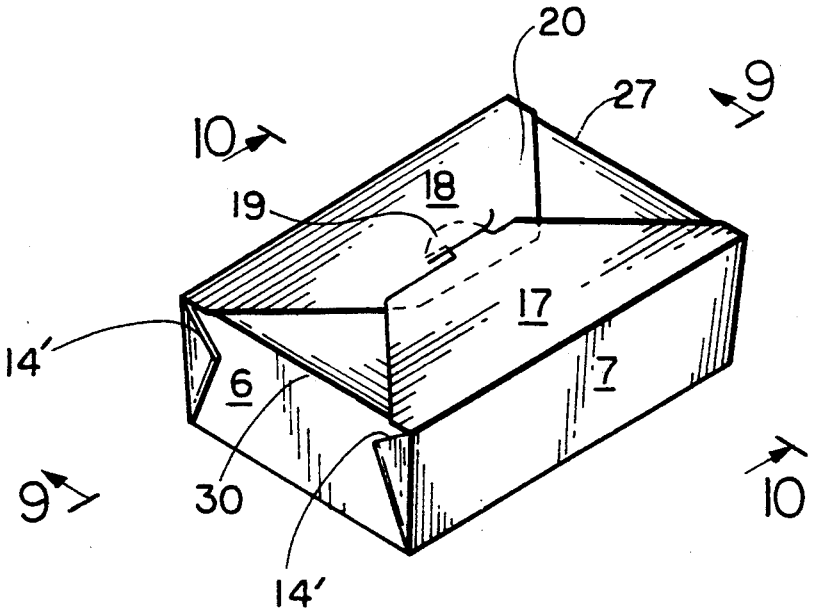
FIG. 12 is a perspective view of the tray assembled from the blank shown in FIG. 11.

Alternatively, the folding sequence can be reversed so that gussets 9 through 12 are preferably secured to respective end portions of side panels 7 and 8. Blank 22 can also be modified as shown in FIG. 11. Each corner edge 39, 43, 47 and 51 of blank 22' is rectilinear over its entire length, rather than piece-wise linear, as in tray blank 22. As illustrated in FIG. 12, the effect of this modification is that upper edge 14' of each folded gusset extends downwardly at a predetermined angle below respective top fold lines 27 and 30.

The illustrated embodiments have proven to be useful for many applications in the food carton art. Further modifications of the present invention will occur to persons skilled in the art to which the present invention pertains. All these modifications are within the scope and spirit of the present invention defined by the claims.

What is claimed is:

1. A reclosable food tray erected from a single unitary blank having an interior and exterior surface and a substantially square gross geometry, which comprises:

a fully constructed receptacle portion having an access opening permitting introduction of food into said receptacle portion having a volumetric geometry defined by a rectangular shaped bottom panel, a first substantially upstanding pair of opposing side panels, a second substantially upstanding pair of opposing side panels said pairs of opposing side panels defining four pairs of adjacent side panels, with each pair of adjacent side panels being hingedly connected by one of four folded gussets, with each of said gussets unitary with said adjacent side panels and secured to the exterior surface of one of said adjacent side panels by an adhesive applied between each said folded gusset and said exterior surface, each said side panel being disposed at a first obtuse angle measured from said bottom panel so that said volumetric geometry facilitates nesting of the receptacle portion of one reclosable food tray within the receptacle portion of another reclosable food tray;

a first pair of opposing closure flaps, each extending from one of said opposing side panels and being capable of closing off a portion of said access opening; and a second pair of opposing closure flaps, each extending from one of the other pair of opposing side panels and being adapted to cooperatively interlock with each other and overlap a portion of said first pair of opposing closure flaps to close off said access opening.

2. The reclosable food tray of claim 1, wherein each said folded gusset is suitably dimensioned so that said receptacle portion is capable of retaining liquid or semi-solid consumables without leakage through said receptacle portion.

3. The reclosable food tray of claim 2, wherein said two substantially upstanding pair of opposing side panels comprise a first side panel disposed opposite a second side panel, a third side panel disposed opposite a fourth side panel, with said first side panel being adjacent said third and said fourth side panels and said second side panel being adjacent said third and said fourth side panels to form a volume having trapezoidal dimensions.

4. The reclosable food tray of claim 1, wherein said blank comprises paperboard material which is substantially resistant to microwave and other heat radiation and said adhesive is resistant to melting upon exposure to said microwave and other heat radiation.

5. The reclosable food tray of claim 1, wherein said first pair of opposing closure flaps are hingedly connected to said respective opposing side panels along respective top fold lines, and each folded gusset has an upper edge which extends substantially along one of said respective top fold lines.

6. The reclosable food tray of claim 5, wherein said first and second pair of opposing side panels are hingedly connected to said bottom panel along respective bottom fold lines, and each side panel has left and right side fold lines, each of which are disposed at a second obtuse angle with respect to adjacent bottom fold lines.

7. The reclosable tray of claim 6, wherein said blank comprises paperboard material which is substantially resistant to microwave and other heat radiation, and said adhesive is resistant to melting upon exposure to microwave and other heat radiation.

8. The reclosable food tray of claim 1, which further comprises a folded partition for insertion into said receptacle portion to divide said receptacle portion into two or more separate food storage compartments.

9. A reclosable food tray constructed from a single unitary blank having an interior and exterior surface, which comprises:

a receptacle portion having an access opening permitting introduction of food into said receptacle portion having a volume defined by a rectangular shaped bottom panel, a first substantially upstanding pair of opposing side panels, a second substantially upstanding pair of opposing side panels said pairs of opposing side panels defining four pairs of adjacent side panels, with each pair of adjacent side panels being hingedly connected by one of four folded gussets, with each of said gussets unitary with said adjacent side panels and secured to the exterior surface of one of said adjacent side panels by an adhesive applied between each said folded gusset and said exterior surface, each said side panel being disposed at a first obtuse angle measured from said bottom panel;

a first pair of opposing closure flaps, each extending from one of said opposing side panels and being capable of closing off a portion of said access opening; and a second pair of opposing closure flaps, each extending from one of the other pair of opposing side panels, said second pair of opposing closure flaps comprise a releasable tab and slot adapted to interlock with each other and overlap a portion of said first pair of opposing closure flaps to close off said access opening.

10. A blank adapted to be folded into a reclosable food tray having a fully constructed receptacle portion with a volumetric geometry which facilitates nesting of the receptacle portion of one food tray within the receptacle portion of another said food tray, said blank having a planar unitary construction, an interior and an exterior surface and a substantially square gross geometry, which comprises:

a bottom panel of rectangular shape having a surface area defined by a first and second pair of opposing bottom fold lines;

a first and second pair of opposing side panels hingedly connected to said bottom panel along said first and second pair of opposing bottom fold lines, said opposing panels defining four pair of adjacent side panels;

four foldable gussets, each said foldable gusset being hingedly connected to each pair of adjacent side panels so that when said first and second opposing side panels are folded substantially upright with respect to said bottom panel, a receptacle portion with an access opening is formed, each said foldable gusset is folded and can be secured to said exterior surface of one of said side panels, and each said side panel is disposed substantially upright at a first predetermined obtuse angle with respect to said bottom panel;

a first pair of opposing closure panels, each hingedly connected to one of said first pair of opposing side panels and being dimensioned to close off a portion of said access opening when folded over said access opening and disposed substantially parallel to said bottom panel;

a second pair of opposing closure panels, each hingedly connected to one of said second pair of opposing side panels and being dimensioned to close off said access opening when folded over said access opening and said first pair of opposing closure panels.

11. The blank of claim 10, wherein said second pair of opposing closure flaps comprises a releasable fastening means to selectively open and close said second pair of closure flaps when folded down over said first pair of closure flaps and said access opening.

12. The blank of claim 10, wherein said first pair of opposing bottom fold lines comprises a first bottom fold line opposing a second bottom fold line, said second pair of opposing bottom fold lines comprises a third bottom fold line opposing a fourth bottom fold line;

said first pair of opposing side panels comprises a first side panel contiguous with said first bottom fold line, and having a surface area defined by a first top fold line, a first left side fold line, a first right side fold line and said first bottom fold line, said first top and bottom fold lines being substantially parallel and said first left and right side fold lines diverging from said first bottom fold line at a said predetermined obtuse angle; and a second side panel disposed opposite of said first side panel, being contiguous with said second bottom fold line, and having a surface area defined by a second top fold line, a second left side fold line, a second right side fold line and said second bottom edge fold line, said second top and bottom fold lines being substantially parallel and said second left and right side fold lines diverging from said second bottom fold lines at said second predetermined obtuse angle; and said second pair of opposing side panels comprises a third side panel contiguous with said third bottom fold line, and having a surface area defined by a third top fold line, a third left side fold line, a third right side fold line and said third bottom fold line, said third top and bottom fold lines being substantially parallel and said third left and right side fold lines diverging from said third bottom fold line at said second predetermined obtuse angle; and a fourth side panel disposed opposite of said second side panel, being contiguous with said fourth bottom fold line, and having a surface area defined by a fourth top fold line, a fourth left side fold line, a fourth right fold and said fourth bottom fold line, said fourth top and bottom fold line being substantially parallel and said fourth left and right side fold lines diverging from said fourth bottom fold line at said second predetermined obtuse angle.

13. The blank of claim 10, wherein said foldable gussets comprise:

a first foldable gusset being contiguous with said first and third side panels, and having a first corner fold line and a first corner edge;

a second foldable gusset being contiguous with said first and fourth side panels, and having a second corner fold line and a second corner edge;

a third foldable gusset being contiguous with said fourth and second side panels, and having a third corner fold line and a third corner edge; and a fourth foldable gusset being contiguous with said second and third side panels, and having a fourth corner fold line and a fourth corner edge.

14. The blank of claim 12, wherein said first pair of opposing closure panels comprises:

a first closure panel being contiguous with said first side panel; and a second closure panel being contiguous with said second side panel; and said second pair of opposing closure panels comprises a third closure panel being contiguous with said third side panel; and a fourth closure panel being contiguous with said fourth side panel.

15. The blank of claim 12, wherein an interlocking means is formed in one of said opposing first and second closure panels or said opposing third and fourth closure panels for selectively opening and closing said opposing closure panels.

16. The blank of claim 11, wherein said first foldable gusset has a surface area generally defined by said first left side fold line, said third right side fold line and said first corner edge;

said second foldable gusset has a surface area generally defined by said first right side fold line, said fourth left side fold line and said second corner edge;

said third foldable gusset has a surface area defined by said fourth right side fold line, said second left side fold line and said third corner edge; and said fourth foldable gusset has a surface area generally defined by said second right side fold line, said third left side fold line and said fourth corner edge.

17. The blank according to claim 14, wherein said first closure panel has a first left closure panel edge, a first right closure panel edge, and a surface area generally defined by said first top fold line, said left closure panel edge and said first right closure panel edge;

said second closure panel has a second left closure panel edge, a second right closure panel edge, and a surface area generally defined by said second top fold line, said second left closure panel edge and said second right closure panel edge;

said third closure panel has a third left closure panel edge, a third right closure panel edge, and a surface area generally defined by said third top fold line, said third left closure panel edge and said third right closure panel edge; and said fourth closure panel has a fourth left closure panel edge, a fourth right closure panel edge, and a surface area generally defined by said fourth top fold line, said fourth left closure panel edge and said fourth right closure panel edge.

18. The blank according to claim 17, wherein said first left closure panel edge has a portion adjacent said first top fold line which is substantially parallel to said third bottom fold line;

said first right closure panel edge has a portion adjacent said first top fold line which is substantially parallel to said fourth bottom fold line;

said second left closure panel edge has a portion adjacent to said second top fold line which is substantially parallel to said fourth bottom fold line; and said second right closure panel edge has a portion adjacent to said second top fold line which is substantially parallel to said third bottom fold line.

19. The blank according to claim 16, wherein said third left closure edge has a portion adjacent to said third top fold line which is substantially parallel to said second bottom fold line;

said third right closure panel edge has a portion adjacent to said third top fold line which is substantially parallel to said first bottom fold line;

said fourth left closure panel edge having a portion adjacent to said fourth top fold line which is substantially parallel to said first bottom fold line; and said fourth right closure panel edge has a portion adjacent to said fourth top fold line which is substantially parallel to said second bottom edge fold line.

20. A blank adapted to be folded into a reclosable food tray having a receptacle portion with a volumetric geometry which facilitates nesting of the receptacle portion of one food tray within the receptacle portion of another said food tray, said blank having planar unitary construction and a substantially square gross geometry, which comprises:

a bottom panel of rectangular shape having a surface area defined by first, second, third and fourth bottom fold lines;

a first side panel contiguous with said first bottom fold line having a surface area defined by a first top fold line, a first left side fold line, a first right side fold line and said first bottom fold line, said first top fold line and said first bottom fold line being substantially parallel and said first left and right side fold lines diverging from said first bottom fold at a predetermined angle;

a second side panel disposed opposite said first side panel and contiguous with said second bottom fold line, having a surface area defined by a second top fold line, a second left side fold line, a second right side fold line and said second bottom fold, said second top and bottom fold lines being substantially parallel and said second left and right side fold lines diverging from said second bottom fold line at said predetermined angle;

a third side panel contiguous with said third bottom fold line having a surface area defined by a third top fold line, a third left side fold line, a third right side fold line and said third bottom fold, said third top and bottom fold lines being substantially parallel and said third left and right side fold lines diverging from said third bottom fold line at said predetermined angle;

a fourth side panel disposed opposite said second side panel and contiguous with said fourth bottom fold line, having a surface area defined by a fourth top fold line, a fourth left side fold line, a fourth right side fold line and said fourth bottom fold line, said fourth top and bottom fold lines being substantially parallel and said fourth left and right side fold lines diverging from said fourth bottom fold line at said predetermined angle;

a first foldable gusset being contiguous with said first and third side panels, and having a first corner fold line and a first corner edge;

a second foldable gusset being contiguous with said first and fourth side panels, and having a second corner fold line and a second corner edge;

a third foldable gusset being contiguous with said fourth and second side panels, and having a third corner fold line and a third corner edge;

a fourth foldable gusset being contiguous with said second and third side panels, and having a fourth corner fold line and a fourth corner edge;

a first closure panel being contiguous with said first side panel;

a second closure panel being contiguous with said second side panel;

a third closure panel being contiguous with said third side panel;

a fourth closure panel being contiguous with said fourth side panel; and fastening means formed in at least one of said closure panels for selectively opening and closing said closure panels.

* * * * *

UNITED STATES PATENT AND TRADEMARK OFFICE

CERTIFICATE OF CORRECTION

PATENT NO. : 5,411,204

DATED : May 2, 1995

INVENTOR(S) : Karl F. DeMay

It is certified that error appears in the above-identified patent and that said Letters Patent is hereby corrected as shown below:

On cover page, item [56], under "OTHER PUBLICATIONS" delete

"Fold-Pak, Chinese Food Pail Blank No. 1J" and substitute

--Fold-Pak, Chinese Food Pail Blank No. 16--.

Signed and Sealed this

Twenty-ninth Day of April, 1997

*Attest:*

*Attesting Officer*

BRUCE LEHMAN

*Commissioner of Patents and Trademarks*